US011433694B2

(12) United States Patent
Kimura et al.

(10) Patent No.: US 11,433,694 B2
(45) Date of Patent: Sep. 6, 2022

(54) SHEET TRAY, SHEET TRANSPORT DEVICE, AND IMAGE FORMING APPARATUS

(71) Applicant: FUJIFILM Business Innovation Corp., Tokyo (JP)

(72) Inventors: Takuyoshi Kimura, Kanagawa (JP); Yasunobu Goto, Kanagawa (JP); Takehiko Koizumi, Kanagawa (JP); Ryuga Oishi, Kanagawa (JP); Natsumi Nakata, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 114 days.

(21) Appl. No.: 16/842,756

(22) Filed: Apr. 7, 2020

(65) Prior Publication Data

US 2021/0107306 A1 Apr. 15, 2021

(30) Foreign Application Priority Data

Oct. 15, 2019 (JP) ..... JP2019-188295

(51) Int. Cl.
*B41J 13/10* (2006.01)
*B65H 31/26* (2006.01)
*B65H 1/08* (2006.01)

(52) U.S. Cl.
CPC ..... *B41J 13/103* (2013.01); *B65H 1/08* (2013.01); *B65H 31/26* (2013.01); *B65H 2801/06* (2013.01)

(58) Field of Classification Search
CPC . B65H 2601/11; B65H 1/266; B65H 2405/31
See application file for complete search history.

(56) References Cited

U.S. PATENT DOCUMENTS

| | | | | |
|---|---|---|---|---|
| 11,001,469 | B2 * | 5/2021 | Nakamura | G03G 21/1638 |
| 2020/0247641 | A1 * | 8/2020 | Inoue | B65H 85/00 |
| 2021/0094783 | A1 * | 4/2021 | Goto | B65H 29/22 |
| 2021/0107755 | A1 * | 4/2021 | Oishi | B65H 85/00 |

FOREIGN PATENT DOCUMENTS

| | | | |
|---|---|---|---|
| JP | 06092485 | A * | 4/1994 |
| JP | 2004035129 | | 2/2004 |
| JP | 2011241012 | | 12/2011 |

* cited by examiner

*Primary Examiner* — Howard J Sanders
(74) *Attorney, Agent, or Firm* — JCIPRNET

(57) ABSTRACT

A sheet tray includes a sheet storage unit that stores a sheet, the sheet storage unit being capable of being pulled out of a housing in a forward direction and pushed into the housing in a rearward direction to a position such that a gap is provided below the sheet storage unit; and a sheet moving portion fixed to the sheet storage unit, the sheet moving portion moving together with the sheet storage unit when the sheet storage unit is pulled out, thereby moving a sheet that has entered the gap in the forward direction.

13 Claims, 4 Drawing Sheets

SHEET TRAY, SHEET TRANSPORT DEVICE, AND IMAGE FORMING APPARATUS

CROSS-REFERENCE TO RELATED APPLICATIONS

This application is based on and claims priority under 35 USC 119 from Japanese Patent Application No. 2019-188295 filed Oct. 15, 2019.

BACKGROUND

(i) Technical Field

The present disclosure relates to a sheet tray, a sheet transport device, and an image forming apparatus.

(ii) Related Art

Image forming apparatuses including a sheet tray that stores sheets and configured to feed a sheet from the sheet tray and form images on both sides of the sheet are known.

For example, Japanese Unexamined Patent Application Publication No. 2011-241012 proposes an image forming apparatus that forms images on both sides of a sheet and that includes an improved mechanism for cleaning a sheet transport path.

Japanese Unexamined Patent Application Publication No. 2004-035129 proposes an image forming apparatus that forms images on both sides of a sheet and that includes a structure for pushing out a sheet that has entered a space below a sheet tray with a pushing unit including a link mechanism that operates in response to a movement of the sheet tray that is pulled out or a movement of an opening-closing covering.

SUMMARY

Aspects of non-limiting embodiments of the present disclosure relate to a sheet tray, a sheet transport device, and an image forming apparatus including a structure for removing a sheet that has entered a space under the sheet tray, the structure being simper than that of the above-described pushing unit including the link mechanism proposed in Japanese Unexamined Patent Application Publication No. 2004-035129.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a sheet tray including a sheet storage unit that stores a sheet, the sheet storage unit being capable of being pulled out of a housing in a forward direction and pushed into the housing in a rearward direction to a position such that a gap is provided below the sheet storage unit; and a sheet moving portion fixed to the sheet storage unit, the sheet moving portion moving together with the sheet storage unit when the sheet storage unit is pulled out, thereby moving a sheet that has entered the gap in the forward direction.

BRIEF DESCRIPTION OF THE DRAWINGS

An exemplary embodiment of the present disclosure will be described in detail based on the following figures, wherein.

DETAILED DESCRIPTION

An exemplary embodiment of the present disclosure will now be described.

Figure 1:
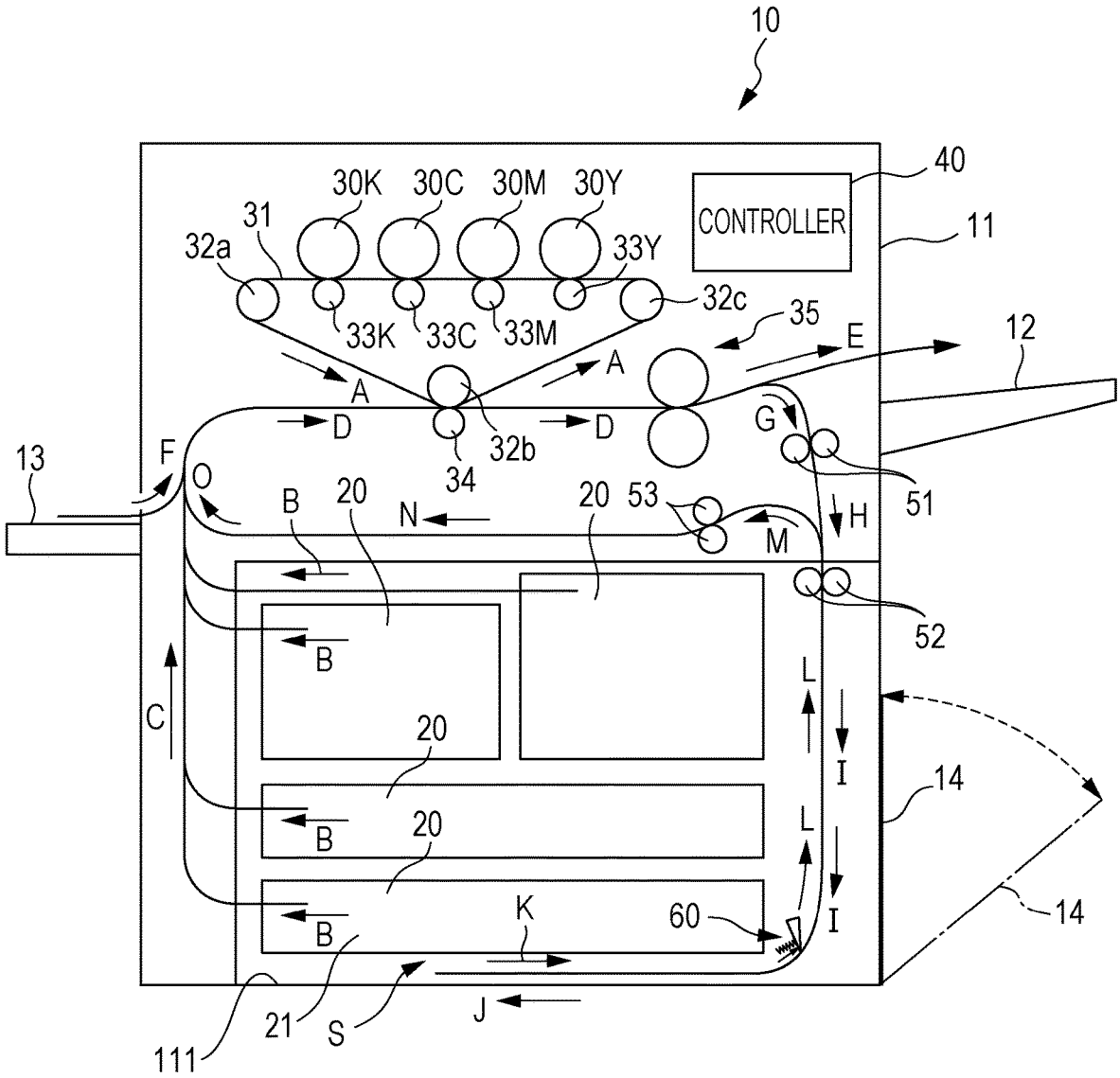
FIG. 1 is a schematic diagram of an image forming apparatus according to an exemplary embodiment of the present disclosure and FIG. 1A is a schematic diagram showing that the transport roller 52 can be opened and the opening of the transport roller 51 is evident relative to the transport roller 51.
Figure 1A:
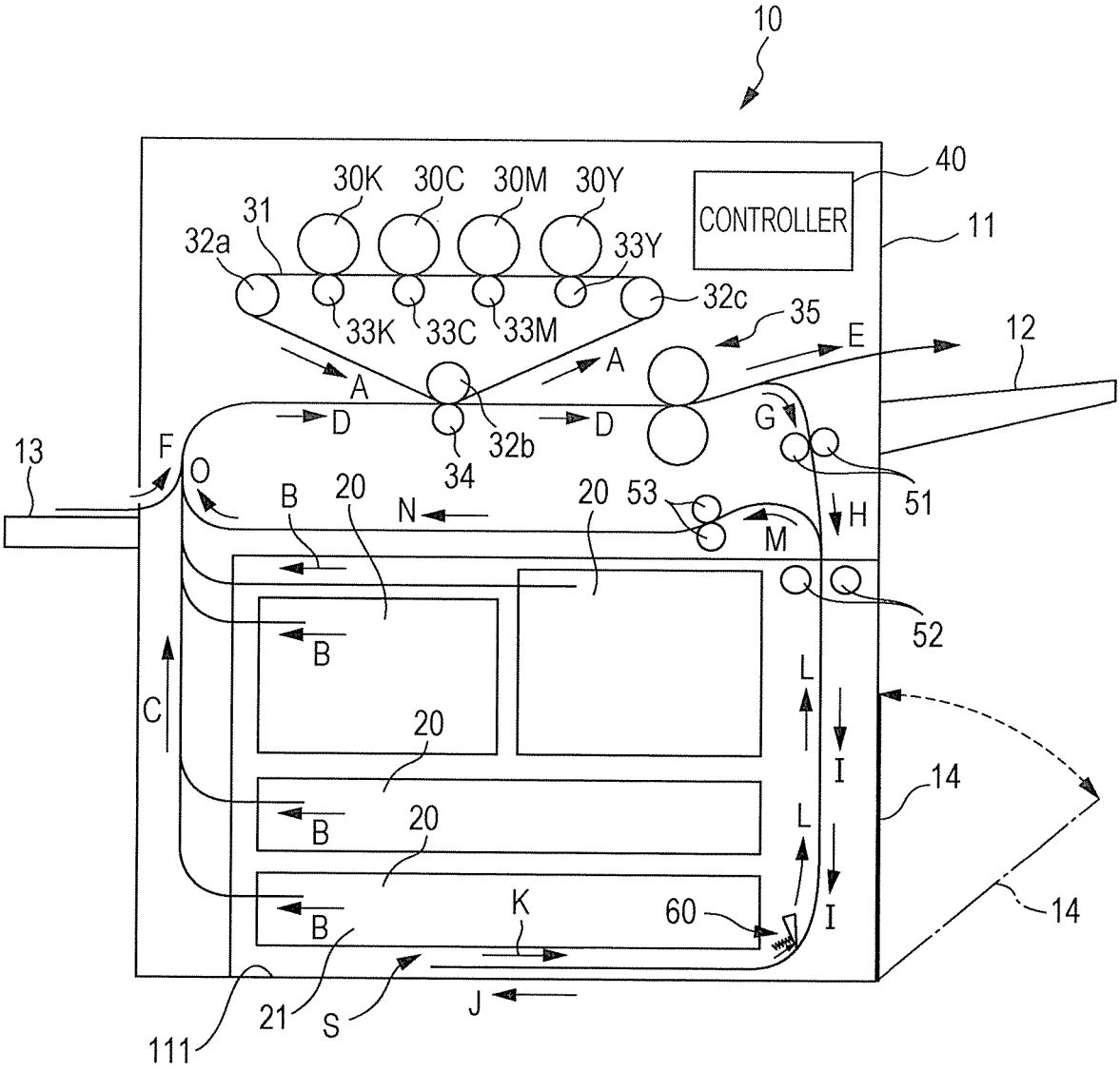

FIG. 1 is a schematic diagram of an image forming apparatus according to an exemplary embodiment of the present disclosure. This image forming apparatus includes a sheet tray according to the exemplary embodiment of the present disclosure and a sheet transport device according to the exemplary embodiment of the present disclosure.

An image forming apparatus 10 illustrated in FIG. 1 includes four sheet trays 20 disposed in a housing 11. These sheet trays 20 are each capable of being pulled out of the housing 11 in a forward direction that is perpendicular to the plane of FIG. 1 and pushed in a backward direction to be placed in the housing 11. The sheet trays 20 store sheets of different types in a stacked state. The image forming apparatus 10 feeds and transports a sheet stored in a designated one of the sheet trays 20, forms an image on the sheet that has been fed, and discharges the sheet having the image formed thereon to a sheet output tray 12. The transportation of the sheet will be described below.

Four image forming engines 30Y, 30M, 30C, and 30K are disposed in an upper section of the housing 11 of the image forming apparatus 10. The image forming engines 30Y, 30M, 30C, and 30K form toner images by using yellow (Y), magenta (M), cyan (C), and black (K) toners, respectively.

An intermediate transfer belt 31 is disposed directly below the image forming engines 30Y, 30M, 30C, and 30K. The intermediate transfer belt 31 is wrapped around plural rollers 32*a*, 32*b*, and 32*c* and rotates in the direction of arrows A. The toner images of the respective colors formed by the image forming engines 30Y, 30M, 30C, and 30K are successively transferred onto the intermediate transfer belt 31 in a superposed manner by the operations of first transfer devices 33Y, 33M, 33C, and 33K. The toner images that have been transferred onto the intermediate transfer belt 31 are transported by the rotation of the intermediate transfer belt 31, and are transferred onto a sheet transported at a suitable timing by the operation of a second transfer device 34. The toner images that have been transferred onto the sheet are fixed to the sheet by being heated and pressed by a fixing device 35. The sheet on which an image composed of the fixed toner images is formed is finally discharged onto the sheet output tray 12.

The image forming apparatus 10 also includes a controller 40. The controller 40 controls the overall operation of the image forming apparatus 10 including the operations of forming the toner images with the image forming engines 30Y, 30M, 30C, and 30K, transferring the toner images onto the intermediate transfer belt 31, transferring the toner images onto the sheet, and transporting the sheet.

A sheet transport passage will now be described. The sheet transport passage is provided with many transport members including transport rollers or the like and gates for switching the path along which the sheet is transported. However, FIG. 1 only illustrates transport rollers 51, 52, and 53 that are arranged at three locations and that are necessary for the description of the characteristic part of the present exemplary embodiment.

In an image forming operation, a sheet is fed leftward in FIG. 1 in the direction of arrows B from one of the sheet trays 20, and transported upward in the direction of arrow C. Among the sheet trays 20, the lowermost sheet tray 21 corresponds to an example of a sheet storage unit according to the present disclosure. The transport path along which the sheet is fed in the direction of arrows B and transported upward in the direction of arrow C corresponds to an example of a first transport path according to the present disclosure.

The sheet transported upward in the direction of arrow C is transported in the direction of arrows D, which is opposite to the direction of arrows B. The transport path in the direction of arrows D corresponds to an example of a second transport path according to the present disclosure. An image is formed on the sheet while the sheet is being transported along the second transport path in the direction of arrows D.

After the toner images are transferred onto the sheet by the operation of the second transfer device 34 and fixed to the sheet by the operation of the fixing device 35 so that an image composed of the fixed toner images is formed on the sheet, the sheet is transported in the direction of arrow E and discharged onto the sheet output tray 12 if the operation mode is not a double-sided printing mode in which images are to be formed on both sides of the sheet. The transport path in the direction of arrow E corresponds to an example of a discharging path according to the present disclosure.

The image forming apparatus 10 also includes a manual feed tray 13, and the sheet may also be fed from the manual feed tray 13. When the sheet is to be fed from the manual feed tray 13, the sheet is placed on the manual feed tray 13. The sheet on the manual feed tray 13 is pulled in the direction of arrow F, and is transported in the direction of arrows D. After that, the sheet is transported along the same transport path as that in the case where the sheet is fed from one of the sheet trays 20.

In the double-sided printing mode in which images are formed on both sides of the sheet, the sheet is transported along transport paths described below.

First, an image is formed on a front side of the sheet. Similar to the above-described case, to form an image on the front side of the sheet, the sheet is fed leftward in FIG. 1 in the direction of arrows B from one of the sheet trays 20, transported upward in the direction of arrow C, and then transport in the direction of arrows D. Then, toner images are transferred onto the front side of the sheet that is transported in the direction of arrows D, and fixed so that an image composed of the fixed toner images is formed on the front side of the sheet.

The sheet having the image formed on the front side thereof moves in the direction of arrow G instead of being transported in the direction of arrow E, and is transported downward in the direction of arrow H by the transport rollers 51. Then, the sheet is further transported downward in the direction of arrows I by the transport rollers 52.

The transport rollers 52 are capable of rotating in forward and reverse directions, and start to rotate in the reverse direction while an upper end of the sheet that is transported downward in the direction of arrows I is still above the transport rollers 52. In the case where the sheet used in the current image forming process has a short length in a transporting direction in which the sheet is transported, the sheet is in a position such that the sheet hangs down from the transport rollers 52 when the reverse rotation is started.

In the case where the length of the sheet is greater than the height of the transport rollers 52 from a bottom plate 111 of the housing 11, the sheet is in a position described below.

A gap S is formed between the lowermost sheet tray 21 among the sheet trays 20 disposed in the housing 11 and the bottom plate 111 of the housing 11. The transport path that extends downward from the transport rollers 52 is connected to the gap S. Therefore, the sheet that is long in the transporting direction is transported downward in the direction of arrows I, and a leading end portion of the sheet enters the gap S and is transported in the direction of arrow J. The top surface of the bottom plate 111 corresponds to an example of a facing surface according to the present disclosure.

The transport rollers 52 start to rotate in the reverse direction while the upper end of the sheet that is transported downward is still above the transport rollers 52. Accordingly, when the sheet is long, the lower end portion of the sheet is transported in the direction of arrow K, and then transported upward in the direction of arrows L. Then, the sheet is transported in the direction of arrow M, and then transported by the transport rollers 53 in the direction of arrow N, which is opposite to the direction of arrows D, in a region below the transport path in the direction of arrows D. The transport path along which the sheet is transported downward in the direction of arrows I and then upward in the direction of arrows L corresponds to an example of a third transport path according to the present disclosure. The transport path along which the sheet is transported in the direction of arrow N corresponds to an example of a fourth transport path according to the present disclosure. The structure according to the present exemplary embodiment that includes a sheet transport path including the above-described first to fourth transport paths and that transports the sheet corresponds to an example of a sheet transport unit according to the present disclosure.

The sheet transported in the direction of arrow N is transported in the direction of arrow O and enters the transport path in the direction of arrows D. By this time, the front and back sides of the sheet are reversed, so that toner images are transferred onto the back side of the sheet when the sheet moves in the direction of arrows D. The toner images that have been transferred onto the back side of the sheet are fixed to the back side of the sheet by the fixing device 35. Thus, images are formed on both front and back sides of the sheet. The sheet having images formed on both sides thereof moves in the direction of arrow E, and is discharged onto the sheet output tray 12.

Assume that a sheet having an image formed on the front side thereof moves in the directions of arrows G, H, and I in the double-sided printing mode and that the upper end thereof passes through the transport rollers 52 and falls in the direction of arrows I. This occurs when, for example, there is a trouble in the sequence, such as a slight delay in starting the reverse rotation of the transport rollers 52, or when the length of the actual sheet is shorter than the length of the designated sheet due to a user error in setting sheets.

The sheet is transported by the transport rollers 51 in the direction of arrow H, and is received and continuously transported by the transport rollers 52. The transport rollers 52 transport the sheet in the direction of arrows I, and then rotate in the reverse direction to transport the sheet in the direction of arrows L. Then, the sheet is transported in the direction of arrow M, and is received and continuously transported by the transport rollers 53. When the sheet that is used is long, the trailing end of the sheet that is received and continuously transported by the transport rollers 53 may be unable to leave the transport rollers 52 before the leading end of the next sheet that is transported by the transport rollers 51 reaches the transport rollers 52. In this exemplary embodiment, the transport rollers 52 are composed of two rollers that nip the sheet therebetween in a releasable manner. More specifically, when the two rollers are opened so that a gap is provided therebetween, the sheet freely moves through the gap between the rollers. At the time when the trailing end of the previous sheet leaves the transport rollers 52, the next sheet is still transported by the transport rollers 51. After the trailing end of the previous sheet leaves the transport rollers 52, the transport rollers 52 are closed to receive the next sheet from the transport rollers 51 and continuously transport the next sheet in the direction of arrows I. In the present exemplary embodiment, the above-described sequence is used to increase the productivity of the image forming operation. However, since the transport rollers 52 are opened and closed, there may be a higher risk that a sheet will pass through the gap between the transport rollers 52 and fall.

When the sheet that has fallen is relatively long, only a portion of the sheet slides into the gap below the sheet tray 21, and an upper portion of the sheet remains in the transport path that extends in the vertical direction. Since the housing 11 has a door 14 on a wall surface along the transport path that extends in the vertical direction, the sheet that has fallen may be taken out by opening the door 14. However, if a short sheet, such as a postcard-sized sheet, is used, the sheet may slip into the gap S below the sheet tray 21 over the entire length thereof.

If the sheet that has slipped into the gap S is not removed, there is a risk that the next sheet will come into contact with the sheet in the gap S and be wrinkled or bent or a transport failure will occur. Therefore, when a sheet slips into the gap S, that sheet needs to be removed. If the sheet tray 21 is configured to be capable of being pulled out of and removed from the housing by the user, the user may remove the sheet as long as the user is aware that the sheet has slipped into the gap S. However, when a large number of large sheets are stacked on the sheet tray 21, removal of the sheet tray 21 is not easy and may be dangerous for the user. Therefore, in the present exemplary embodiment, the sheet tray 21 is not configured to be removable by the user. In addition, the bottom of the housing 11 needs to be blocked by the bottom plate 111 for safety reasons, for example, to prevent fire. Accordingly, in the present exemplary embodiment, a sponge-like elastic body 60 that is used as a gasket is attached to a bottom plate 211 of the sheet tray 21. If there is a sheet that has slipped into the gap S, the sheet is pushed out by the elastic body 60 when the sheet tray 21 is pulled out of the housing 11.

Figure 2A:
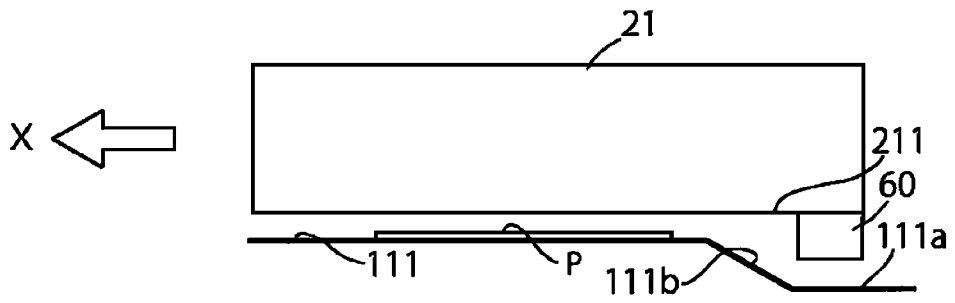
FIGS. 2A and 2B are schematic diagrams illustrating a sheet that has slipped into a gap between a bottom plate of a housing and a sheet tray.
Figure 2B:
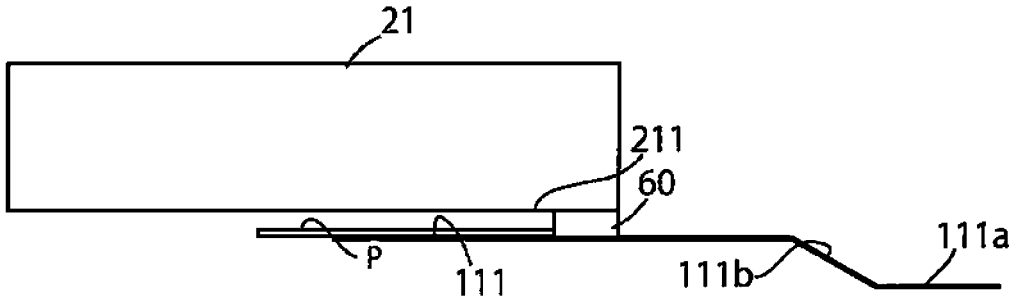

FIGS. 2A and 2B are schematic diagrams illustrating a sheet that has slipped into the gap between the bottom plate of the housing and the sheet tray. FIG. 2A shows the sheet tray that is not yet pulled out, and FIG. 2B shows the sheet tray that has been pulled out. The sheet tray 21 is pulled out in the direction of arrow X in FIG. 2A. The direction of arrow X is perpendicular to the plane of FIG. 1.

The top surface of the bottom plate 111 of the housing 11 (see FIG. 1) has a height difference such that a rear portion (right portion in FIG. 2) 111*a* thereof is lower than a portion in front thereof. These portions are connected to each other by an inclined surface 111*b*. The elastic body 60 is attached to a rear portion of the bottom plate 211 of the sheet tray 21. The elastic body 60 corresponds to an example of a sheet moving portion according to the present disclosure. The sheet tray 21 corresponds to an example of a sheet storage unit according to the present disclosure.

A rear portion of the sheet tray 21 is above the low portion 111*a* of the bottom plate 111 of the housing 11 when the sheet tray 21 is placed in the housing 11. The thickness of the elastic body 60 is greater than the height of the gap S, but is less than the distance between the low portion 111*a* of the bottom plate 111 and the bottom plate 211 of the sheet tray 21. Therefore, when the sheet tray 21 is placed in the housing 11, the elastic body 60 is not in contact with the bottom plate 111 of the housing 11.

Referring to FIG. 2A, assume that a sheet P has entered the gap S. In such a case, as illustrated in FIG. 2B, the sheet tray 21 is pulled forward in the direction of arrow X. As a result, the elastic body 60 comes into contact with the bottom plate 111 of the housing 11 and elastically contracts when the elastic body 60 passes the inclined surface 111*b*. Thus, the elastic body 60 pushes the sheet P to a protruding position at which the sheet P protrudes forward (leftward in FIG. 2B) from the housing 11. When the sheet tray 21 is pushed back into the housing, the elastic body 60 moves together with the sheet tray 21 and returns to the rear position in the housing 11 while the sheet P remains at the protruding position. Thus, the sheet that protrudes from the housing 11 at the protruding position may be picked up and removed from the housing 11.

According to this structure, the elastic body 60 is not compressed when the sheet tray 21 is placed in the housing 11. Therefore, degradation of the elastic body is less than that when the elastic body is constantly compressed. When the sheet tray 21 is pulled out of the housing 11, the elastic body 60 is compressed by the bottom plate 111 of the housing 11. Accordingly, the risk that the sheet cannot be pushed to a predetermined position is less than that when the elastic body 60 does not come into contact with the bottom plate 111 of the housing 11 or is not compressed.

As illustrated in FIG. 1, the elastic body 60 extends over the entire width of the sheet tray 21 in the left-right direction in FIG. 1. The overall width of the sheet tray 21 is equal to the overall length of the region in the gap S that receives the sheet P in the left-right direction in FIG. 1. According to the present exemplary embodiment, since the elastic body 60 extends in the above-described manner, the sheet at any position in the gap S may be pushed by the elastic body 60 and removed no matter how short the sheet is. Also, additional effects described below may be obtained.

Figure 3A:
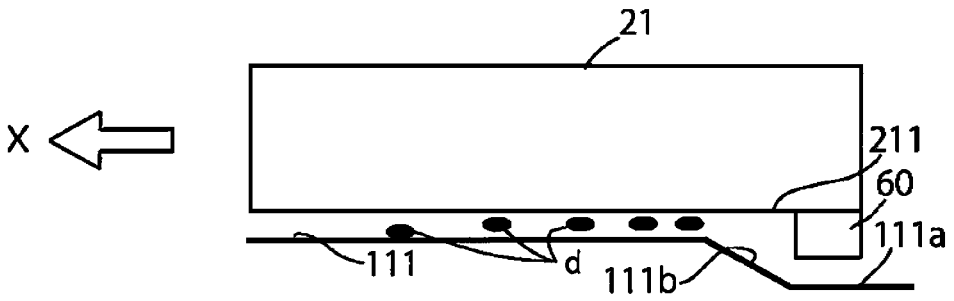
FIGS. 3A and 3B are schematic diagrams illustrating the positional relationship between the bottom plate of the housing and the sheet tray similar to that in FIGS. 2A and 2B.
Figure 3B:
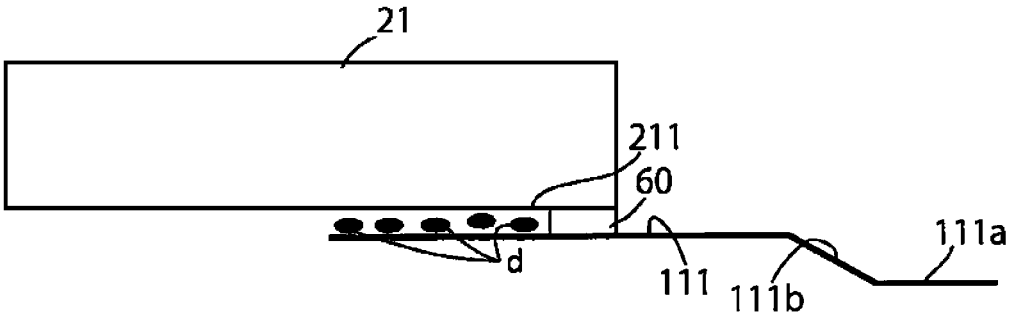

FIGS. 3A and 3B are schematic diagrams illustrating the positional relationship between the bottom plate of the housing and the sheet tray similar to that in FIGS. 2A and 2B. FIG. 3A shows the sheet tray that is not yet pulled out, and FIG. 3B shows the sheet tray that has been pulled out. Similar to the case illustrated in FIG. 2A, the sheet tray 21 is pulled out in the direction of arrow X in FIG. 3A.

The gap S is used as a portion of the sheet transport path, and is at the lowermost region. Therefore, dust d, such as paper dust, easily accumulates in the gap S. As illustrated in FIG. 3B, when the sheet tray 21 is pulled out, the dust d is pushed forward to a position where the dust d may be easily removed. When the dust d is occasionally removed, the risk that the dust d will adhere to a sheet and the sheet will become dirty is reduced.

In the present exemplary embodiment, the compressible elastic body 60 is used as an example of the sheet moving portion according to the present disclosure. However, the sheet moving portion according to the present disclosure is not limited to the compressible elastic body 60, and may instead be, for example, a film made of PET or the like or a metal plate that comes into contact with the bottom plate 111 of the housing 11.

In addition, although the top surface of the bottom plate 111 serves as the facing surface according to the present disclosure, the facing surface according to the present disclosure is not limited to the top surface of the bottom plate 111. When, for example, a certain member or device included in the image forming apparatus 10 is disposed above the bottom plate 111 and when the sheet tray 21 is disposed above the member or device with a gap therebetween, the top surface of the member or device may serve as the facing surface.

Although the image forming apparatus 10 that forms an image by an electrophotographic method and a sheet transport device installed in the image forming apparatus are described, the image forming apparatus according to the present disclosure may be an image forming apparatus that forms an image by a method other than the electrophotographic method, such as an inkjet method. Also, the sheet transport device according to the present disclosure may be a sheet transport device installed in an image forming apparatus that forms an image by a method other than the electrophotographic method. Also, the sheet transport device according to the present disclosure may be applied to a sheet transport device installed in an apparatus that is other than an image forming apparatus and in which a sheet needs to be reversed.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A sheet tray comprising:

a sheet storage unit comprising a bottom plate that stores a sheet to be placed on the bottom plate, the sheet storage unit being capable of being pulled out of a housing in a forward direction and pushed into the housing in a rearward direction to a position such that a gap is provided below the sheet storage unit; and a sheet moving portion directly attached to the bottom plate of the sheet storage unit, the sheet moving portion moving together with the sheet storage unit when the sheet storage unit is pulled out, thereby moving a sheet that has entered the gap in the forward direction, wherein the sheet moving portion is an elastic body that is compressed by coming into a contact with a facing surface that faces the sheet storage unit with a gap therebetween, and wherein the facing surface has a height difference such that the elastic body is not compressed when the sheet storage unit is placed in the housing and that the elastic body is compressed by coming into contact with the facing surface when the sheet storage unit is pulled out.

2. The sheet tray according to claim 1, wherein the sheet moving portion is fixed in the gap at a position behind the sheet that has entered the gap, and pushes the sheet that has entered the gap in the forward direction when the sheet storage unit is pulled out.

3. The sheet tray according to claim 2, wherein the sheet moving portion pushes the sheet that has entered the gap in the forward direction to a protruding position, at which a portion of the sheet protrudes from the housing, when the sheet storage unit is pulled out.

4. The sheet tray according to claim 3, wherein the sheet moving portion pushes the sheet to the protruding position when the sheet storage unit is pulled out, and then leaves the sheet at the protruding position when the sheet storage unit is pushed into the housing.

5. The sheet tray according to claim 4, wherein the sheet moving portion is an elastic body that is compressed by coming into contact with a facing surface that faces the sheet storage unit with the gap therebetween.

6. The sheet tray according to claim 5, wherein the elastic body is shaped to extend over an entire length of a region in the gap that is entered by the sheet in a left-right direction.

7. The sheet tray according to claim 3, wherein the sheet moving portion is an elastic body that is compressed by coming into contact with a facing surface that faces the sheet storage unit with the gap therebetween.

8. The sheet tray according to claim 7, wherein the elastic body is shaped to extend over an entire length of a region in the gap that is entered by the sheet in a left-right direction.

9. The sheet tray according to claim 1, wherein the elastic body is shaped to extend over an entire length of a region in the gap that is entered by the sheet in a left-right direction.

10. A sheet transport device comprising:

a housing;

the sheet tray according to claim 1; and a sheet transport unit that includes a sheet transport path and transports a sheet, wherein the sheet transport path includes a first transport path along which the sheet is fed from the sheet storage unit in a first direction along a left-right direction that crosses a front-rear direction and then transported upward, a second transport path that receives the sheet that has been transported upward along the first transport path and transports the sheet in a second direction along the left-right direction, a discharging path that receives the sheet that has been transported in the second direction along the second transport path and discharges the sheet out of the housing, a third transport path that is connected to the gap and that receives the sheet that has been transported in the second direction along the second transport path when a transport passage for the sheet is switched to the third transport path from the discharging path, the third transport path transporting the sheet downward and then upward, and a fourth transport path that receives the sheet that has been transported downward and then upward along the third transport path and transports the sheet in the first direction below the second transport path to feed the sheet to the second transport path.

11. The sheet transport device according to claim 10, wherein the sheet transport unit includes a pair of sheet driving portions that support the sheet therebetween in a releasable manner, the sheet driving portions receiving the sheet that has been transported along the second transport path and transporting the sheet downward to feed the sheet to the third transport path, and then transporting the sheet that has been fed to the third transport path upward to feed the sheet to the fourth transport path.

12. An image forming apparatus comprising:

the sheet transport device according to claim 1, wherein an image is formed on a sheet while the sheet is being transported along the second transport path.

13. An image forming apparatus comprising:

a housing;

a sheet storage unit comprising a bottom plate that stores a sheet to be placed on the bottom plate, the sheet storage unit being capable of being pulled out of the housing in a forward direction and pushed into the housing in a rearward direction to a position such that a gap is provided below the sheet storage unit;

a sheet transport unit that transports the sheet to a space between the sheet storage unit and a facing surface that faces the sheet storage unit with the gap therebetween; and a sheet moving portion directly attached to the bottom plate the sheet storage unit, the sheet moving portion moving together with the sheet storage unit while being in contact with the facing surface when the sheet storage unit is pulled out, thereby moving a sheet that has entered the gap in the forward direction, wherein the sheet moving portion is an elastic body that is compressed by coming into a contact with a facing surface that faces the sheet storage unit with a gap therebetween, and wherein the facing surface has a height difference such that the elastic body is not compressed when the sheet storage unit is placed in the housing and that the elastic body is compressed by coming into contact with the facing surface when the sheet storage unit is pulled out.

* * * * *